US007570236B2

(12) United States Patent
Han et al.

(10) Patent No.: US 7,570,236 B2
(45) Date of Patent: Aug. 4, 2009

(54) DISPLAY DEVICE AND METHOD FOR DRIVING THE SAME

(75) Inventors: Min-Koo Han, Seoul (KR); Jae-hoon Lee, Seoul (KR)

(73) Assignees: Samsung Electronics Co., Ltd. (KR); Seoul National University Industry Foundation (KR)

( * ) Notice: Subject to any disclaimer, the term of this patent is extended or adjusted under 35 U.S.C. 154(b) by 266 days.

(21) Appl. No.: 11/560,562

(22) Filed: Nov. 16, 2006

(65) Prior Publication Data

US 2007/0126680 A1 Jun. 7, 2007

(30) Foreign Application Priority Data

Dec. 2, 2005 (KR) ..... 10-2005-0117198

(51) Int. Cl.
*G09G 3/32* (2006.01)

(52) U.S. Cl. ..... 345/82; 345/204; 345/78; 315/169.3

(58) Field of Classification Search ..... 313/491, 313/495, 498, 500, 505; 315/169.1–169.4; 345/204, 690–697, 82–84, 76–78, 214
See application file for complete search history.

(56) References Cited

U.S. PATENT DOCUMENTS 7,202,606 B2 * 4/2007 Eom et al. ..... 315/169.3
2004/0056828 A1 * 3/2004 Choi et al. ..... 345/82
2004/0196223 A1 * 10/2004 Kwon ..... 345/82

* cited by examiner

*Primary Examiner*—Douglas W Owens
*Assistant Examiner*—Ephrem Alemu
(74) *Attorney, Agent, or Firm*—Cantor Colburn LLP

(57) ABSTRACT

A display device for compensating for degradation of a threshold voltage of a driving thin-film transistor ("TFT") and method for driving the display device includes a light-emitting element, wherein the light-emitting element emits light by a driving current applied thereto, a driving TFT controlling the magnitude of the driving current directed to the light-emitting element, a capacitor which charges a voltage which varies depending on a data voltage and a threshold voltage of the driving TFT and maintains a voltage corresponding to a difference between the data voltage and a gate voltage of the driving TFT, a first switching unit supplying the data voltage to the capacitor in response to a scan signal, and a second switching unit which is diode-connected and supplies the driving TFT with a light emitting signal.

26 Claims, 8 Drawing Sheets

DISPLAY DEVICE AND METHOD FOR DRIVING THE SAME

This application claims priority to Korean Patent Application No. 10-2005-0117198, filed on Dec. 2, 2005, and all the benefits accruing therefrom under 35 U.S.C. §119, the contents of which in its entirety are herein incorporated by reference.

BACKGROUND OF THE INVENTION

1. Field of the Invention

The present invention relates generally to a display device and method for driving the same, and more particularly, to a display device which compensates for degradation of threshold voltage of a driving thin-film transistor and a method for driving the same.

2. Description of the Related Art

Presently, many efforts are being made to study and develop various types of flat panel display devices, such as liquid crystal displays ("LCDs"), field emission displays ("FEDs"), organic light emitting diodes ("OLEDs") and plasma display panels ("PDPs").

An organic light emitting display device is a self-emissive display that displays an image by electrically exciting a fluorescent organic material. The organic light emitting display device offers several advantages including low power consumption, wide viewing angle, fast response time, and so on, thereby facilitating a high quality moving image display.

An organic light emitting display device includes an OLED and a thin-film transistor ("TFT") for driving the same. TFTs are classified into polycrystalline silicon TFTs and amorphous TFTs depending on the type of active layer used.

An organic light emitting display device using amorphous TFTs can easily achieve a large display size. However, use of amorphous TFTs for more than a predetermined time may degrade and change a threshold voltage Vth of the amorphous TFTs. Degradation of the threshold voltage Vth may prevent uniform current flow through the OLED even though the same data voltage is applied to the organic light emitting display device, thus degrading the image display quality of the organic light emitting display device.

Meanwhile, an organic light emitting display device exhibits a change in the threshold voltage as current flows over a long period of time. For example, it is assumed that an organic light emitting display device is connected to a source of an n-channel metal oxide semiconductor ("n-MOS") TFT. In any event where a threshold voltage of the organic light emitting display device deteriorates, a source voltage of a driving TFT inevitably changes. Accordingly, even if the same voltage is applied to the gate of the TFT, non-uniform current flows through the OLED due to a change in the gate-source voltage of the TFT, thereby resulting in degradation of the image display quality of the organic light emitting display device.

BRIEF SUMMARY OF THE INVENTION

The present invention provides a display device which compensates for degradation of a threshold voltage.

The present invention also provides a method for driving the display device which compensates for degradation of a threshold voltage.

These and other aspects, features and advantages of the present invention will be described in, or be apparent to those skilled in the art, from the following description of the exemplary embodiments.

According to an exemplary embodiment of the present invention, a display device includes a light-emitting element which emits light when a driving current is applied thereto, a driving thin-film transistor ("TFT") controlling the magnitude of the driving current applied to the light-emitting element, a capacitor charging a voltage which varies depending on data voltage and a threshold voltage of the driving TFT and maintaining a voltage corresponding to a difference between the data voltage and a gate voltage of the driving TFT, a first switching unit supplying the data voltage to the capacitor in response to a scan signal and a second switching unit which is diode-connected and applies a light emitting signal to the driving TFT.

According to another exemplary embodiment of the present invention, a display device includes a capacitor formed between a first and a second node, a light-emitting element which emits light when a driving current is applied thereto, a driving thin-film transistor formed between the light-emitting element and a third node which controls the magnitude of the driving current applied to the light-emitting element, a first switching unit including first through third switching thin-film transistors gated in response to a scan signal, wherein the first switching thin-film transistor is formed between the second and third node, the second switching thin-film transistor is formed between the first node and a data line, and the third switching thin-film transistor is formed between the light-emitting element and a ground voltage line, and a second switching unit including fourth and fifth switching thin-film transistors gated in response to a light-emitting signal, wherein the fourth switching thin-film transistor is diode connected to a light-emitting signal line and the fifth switching thin-film transistor is formed between the first node and the light-emitting element.

According to another exemplary embodiment of the present invention, a display device includes a light-emitting element which emits light when a driving current is applied thereto, a driving thin-film transistor ("TFT") controlling the magnitude of the driving current applied to the light-emitting diode, a capacitor charging a voltage which varies depending on a data current and a threshold voltage of the driving TFT and maintaining a voltage corresponding to a difference between a gate-source voltage and the threshold voltage of the driving TFT, a first switching unit supplying the data current to the capacitor in response to a scan signal, and a second switching unit which is diode-connected and applies a light-emitting signal to the driving TFT.

According to another exemplary embodiment of the present invention, a display device includes a capacitor formed between a first and a third node, a light-emitting element which emits light when a driving current is applied thereto, a driving thin-film transistor formed between the light-emitting element and a second node which controls the magnitude of the driving current applied to the light-emitting element, a first switching unit including first through third switching thin-film transistors gated in response to a scan signal, wherein the first switching thin-film transistor is formed between the first and second node, the second switching thin-film transistor is formed between the first node and a data line, and the third switching thin-film transistor is formed between the light-emitting element and a ground voltage line, and a second switching unit including a fourth switching thin-film transistors gated in response to a light-emitting signal, wherein the fourth switching thin-film transistor is formed between the second node and the light-emitting signal line.

According to still another exemplary embodiment of the present invention, there is provided a method for driving a display device including a light-emitting element which emits light when a driving current is applied thereto, a driving thin-film transistor ("TFT") controlling the magnitude of the driving current applied to the light-emitting element, a capacitor charging a voltage which varies depending on a data voltage and a threshold voltage of the driving TFT and maintaining a voltage corresponding to a difference between the data voltage and a gate voltage of the driving TFT, a first switching unit supplying the data voltage to the capacitor in response to a scan signal, and a second switching unit which is diode-connected and applies a light-emitting signal to the driving TFT, the method includes pre-charging the capacitor to a predetermined voltage, charging the capacitor to a voltage corresponding to the difference between the data voltage and the gate voltage of the driving TFT, maintaining the voltage corresponding to the difference between the data voltage and the gate voltage of the driving TFT, and emitting light from the light-emitting element using the voltage corresponding to the difference between the data voltage and the gate voltage of the driving TFT.

According to another exemplary embodiment of the present invention, there is provided a method for driving a display device including a light-emitting element which emits light when a driving current is applied thereto, a driving thin-film transistor ("TFT") controlling the magnitude of the driving current applied to the light-emitting element, a capacitor charging a voltage which varies depending on a data current and a threshold voltage of the driving TFT and maintaining a voltage corresponding to a difference between a gate-source voltage and the threshold voltage of the driving TFT, a first switching unit supplying the data current to the capacitor in response to a scan signal, and a second switching unit which is diode-connected and applies a light-emitting signal to the driving TFT, the method includes charging the capacitor to a predetermined voltage depending on the data current and the threshold voltage of the driving thin-film transistor, maintaining the voltage charged in the capacitor corresponding to a difference between the gate-source voltage and the threshold voltage of the driving thin-film transistor, and emitting light from the light-emitting element using the voltage corresponding to a difference between a gate-source voltage and the threshold voltage of the driving thin-film transistor.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
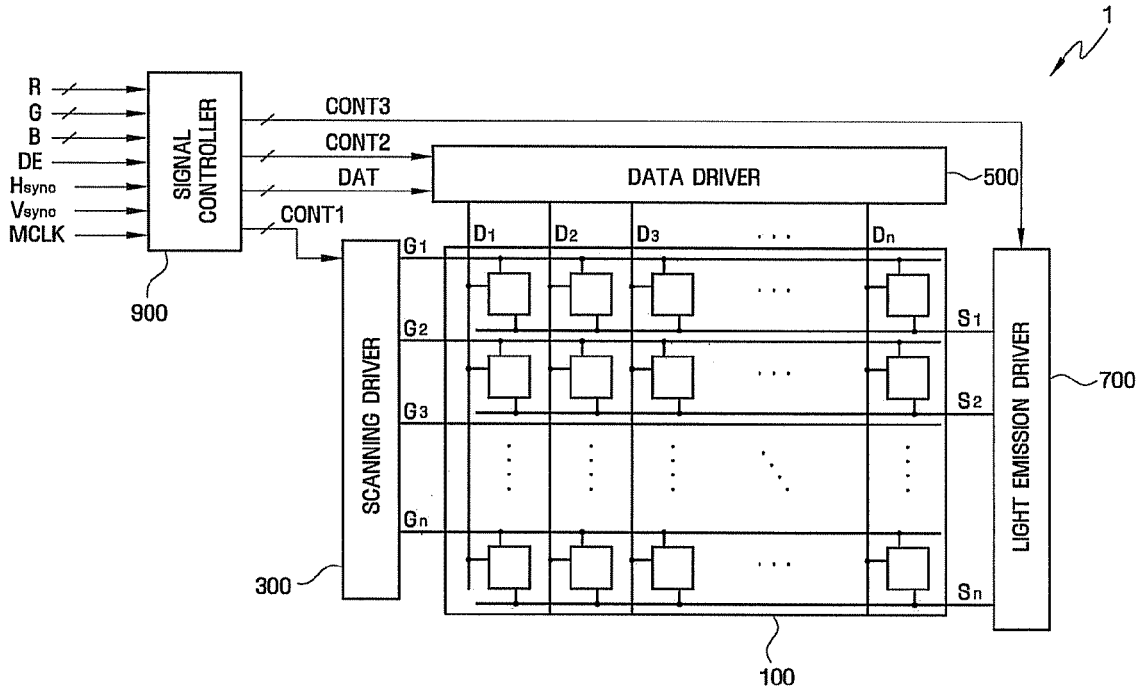
FIG. 1 is a schematic block diagram of an exemplary embodiment of an organic light emitting display device according to the present invention.

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein.

Rather, these exemplary embodiments are provided so that this disclosure will be thorough and complete and will fully convey the concept of the invention to those skilled in the art. Like reference numerals refer to like elements throughout the specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The present invention, and exemplary embodiments thereof, will be described hereinafter with reference to the drawings. FIG. 1 is a schematic block diagram of an exemplary organic light emitting display device 1 according to the present invention.

Referring to FIG. 1, the organic light emitting display device 1 includes a display panel 100, a scanning driver 300, a data driver 500 and a light emission driver 700 connected to the display panel 100, and a signal controller 900 controlling the scanning driver 300, the data driver 500 and the light emission driver 700.

The display panel 100 is connected to a plurality of signal lines G1 through Gn, D1 through Dn, and S1 through Sn and includes a plurality of pixels arranged substantially in a matrix form. The construction of each of the plurality of pixels will be described later with reference to FIGS. 2-4.

The plurality of signal lines include a plurality of scan signal lines G1 through Gn responsible for transmission of scan signals, a plurality of data lines D1 through Dn responsible for transmission of data signals, and a plurality of light-emitting signal lines S1 through Sn responsible for transmission of a plurality of light-emitting signals. The scan signal lines G1 through Gn and the light-emitting signal lines S1 through Sn extend substantially parallel to each other in a row direction, while the data lines D1 through Dn extend substantially parallel to each other in a column direction substantially perpendicular to the scanning signal lines and light-emitting signal lines.

In a conventional display, the display panel 100 includes a separate driving voltage line for transmission of a driving voltage Vdd. However, according to an exemplary embodiment of the present invention the organic light emitting display device 1 uses the light-emitting signal lines S1 though Sn as the driving voltage lines. One resulting advantage of this arrangement includes a smaller number of total signal lines; therefore the total number of pixels per inch ("PPI") may be increased, thereby achieving a higher pixel density, and higher resolution display.

The scanning driver 300 is connected to the plurality of scan signal lines G1 through Gn of the display panel 100. The scanning driver 300 applies a scan signal to each of the scan signal lines G1 through Gn. The scan signal consists of a combination of a gate-on voltage Von to turn a switching TFT on and a gate-off voltage Voff to turn the switching TFT off. The scanning driver 300 may include a plurality of integrated circuits ("ICs"). The data driver 500, which includes a plurality of ICs, is connected to the plurality of data lines D1 through Dn of the display panel 100. The data driver 500 applies a data voltage Vdata to each of the plurality of pixels to represent an image signal.

The light emission driver 700, which may include a plurality of ICs, is connected to the plurality of light-emitting signal lines S1 through Sn of the display panel 100. The light emission driver 700 applies a light-emitting signal to each of the light-emitting signal lines S1 through Sn. The light-emitting signal consists of a combination of a gate-on voltage Von which causes a switching TFT to turn on and a gate-off voltage Voff which causes the switching TFT to turn off.

The signal controller 900 controls the operation of the scanning driver 300, the data driver 500 and the light emission driver 700.

According to an exemplary embodiment of the present invention, at least the scanning driver 300, the data driver 500, or the light emission driver 700 may be attached onto the display panel 100 in the form of a plurality of driving integrated circuit ("IC") chips or be mounted on a flexible printed circuit film (not shown) and attached to the display panel 100 in the form of a tape carrier package ("TCP"). According to an alternative exemplary embodiment, at least the scanning driver 300, the data driver 500, or the light emission driver 700 may be integrated onto the display panel 100.

The signal controller 900 receives R, G and B image signals and input control signals controlling the display of the R, G and B image signals, such as a vertical synchronization signal Vsync and a horizontal synchronization signal Hsync, a main clock MCLK, a data enable signal DE, etc., from an external graphic controller (not shown). In addition, the signal controller 900 processes the R, G and B image signals suitably according to the operation conditions of the display panel 100 and generates a scan control signal CONT1, a data control signal CONT2, and a light-emitting signal CONT3 based on the input image signals R, G and B and the input control signals. The signal controller 900 then provides the scan control signal CONT1, the data control signal CONT2 and the processed image signal DAT, and the light-emitting signal CONT3 to the scanning driver 300, the data driver 500, and the light emission driver 700, respectively.

The scan control signal CONT1 includes a vertical synchronization start signal STV (not shown) for indicating the start of scanning of a gate-on voltage and at least one clock signal for controlling the output of the gate-on voltage Von (also not shown). The data control signal CONT2 includes a horizontal synchronization signal STH (not shown) for indicating the transmission of data corresponding to one row of pixels, a load signal LOAD (not shown) for instructing to apply an appropriate data voltage Vdata to each of the data lines D1 through Dn, and a data clock signal HCLK.

Figure 2:
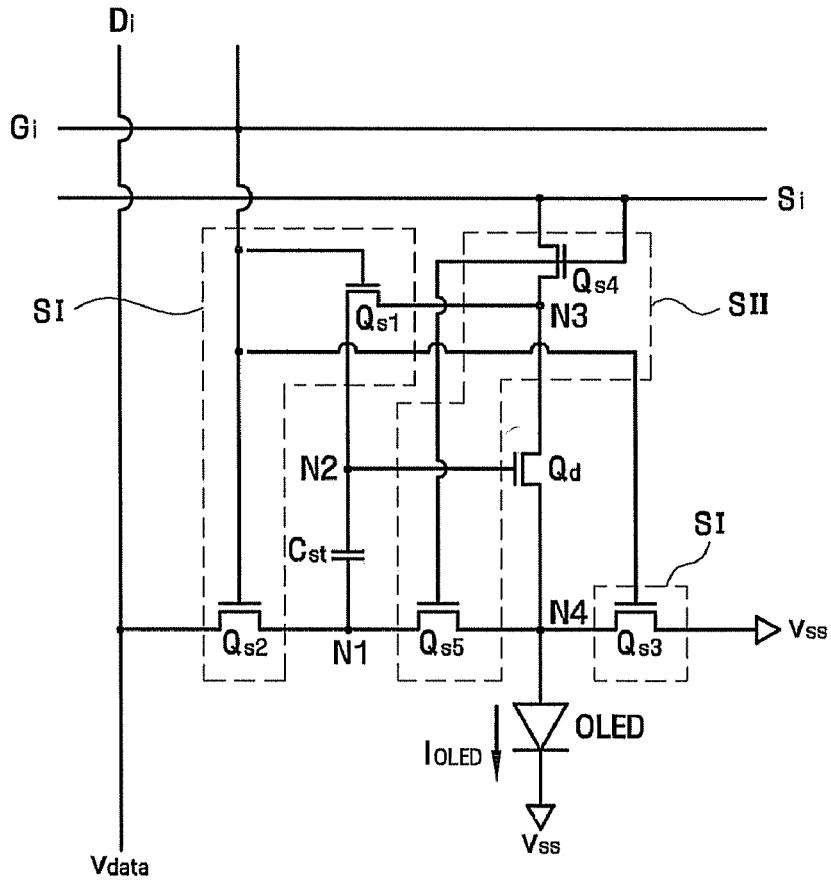
FIG. 2 is an equivalent circuit schematic diagram of an exemplary embodiment of a pixel in an organic light emitting display device according to the present invention.

FIG. 2 is an equivalent circuit schematic diagram of an exemplary embodiment of a pixel in an organic light emitting display device according to the present invention.

Referring to FIG. 2, each pixel includes an OLED, a driving TFT Qd, a capacitor Cst, a first switching unit SI, and a second switching unit SII.

The OLED includes an emitting layer ("EML") where electrons provided through an electron transport layer ("ETL") and holes provided through a hole transport layer ("HTL") combine to produce light (not shown). In order to improve operating characteristics, the OLED may further include an electron injection layer ("EIL") and a hole injection layer ("HIL") (both not shown). Electrons are injected into the ETL through the EIL and holes are injected into the HTL through the HIL.

The OLED emits light due to a current $I_{OLED}$ which is supplied by a driving TFT Qd depending on a gate-source voltage of the driving TFT Qd (between a second node N2 and a fourth node N4). The driving TFT Qd is formed between the third node N3 and the fourth node N4 and the gate is connected to a second node N2. The third node N3 is connected to a light-emitting signal line Si via a switching TFT Qs4.

The capacitor Cst is formed between a first node N1 and the second node N2. Switching TFTs Qs1, Qs2 and Qs3 in the first switching unit SI operate in response to the scan signal.

The switching TFT Qs1 is connected between the second node N2 and the third N3 of the driving TFT Qd. with its gate terminal connected to scan signal line Gi. The switching TFT Qs2 is connected between data line Di, which supplies the data voltage Vdata, and the first node N1 with its gate terminal connected to scan signal line Gi. The switching TFT Qs3 is connected between the fourth node N4 and a ground voltage Vss with its gate terminal connected to scan signal line Gi.

Switching TFTs Qs4 and Qs5 in the second switching unit SII operate in response to the light-emitting signal.

The switching TFT Qs4 is connected between the light-emitting signal line Si and the third node N3 with its gate terminal connected to the light-emitting signal line Si. The switching TFT Qs5 is connected between the capacitor Cst and the fourth node N4 with its gate terminal connected to the light-emitting signal line Si.

The switching TFTs Qs1 through Qs5 and the driving TFT Qd are n-channel metal oxide semiconductor ("nMOS") TFTs made of amorphous silicon ("a-Si") or p-channel MOS ("pMOS") TFTs. When pMOS TFTs are used, the operation, voltage, and current in the pMOS TFTs are opposite to those in nMOS TFTs because they are complementary to each other.

The operation of an exemplary embodiment of an organic light emitting display device will now be described with reference to FIGS. 3 and 4.

Figure 3:
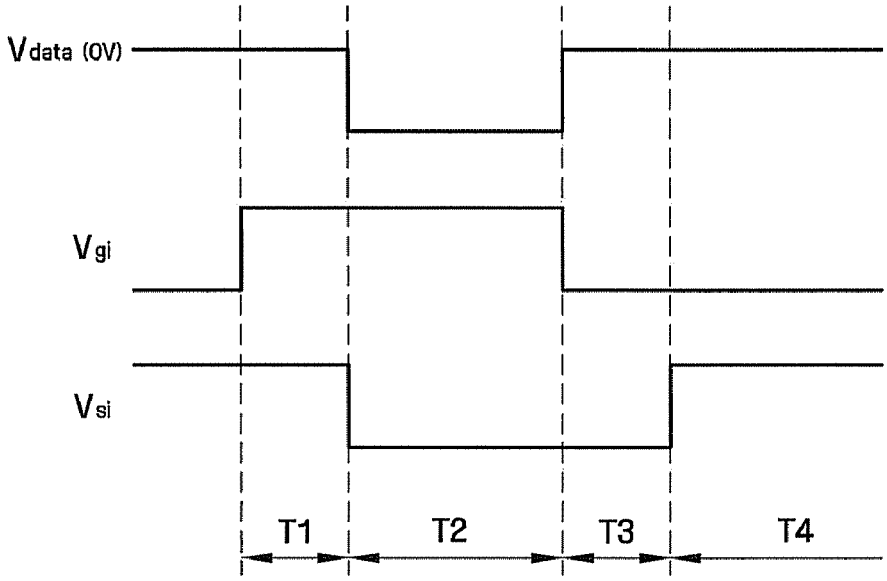
FIG. 3 is a timing diagram of an exemplary embodiment of a signal for driving an organic light emitting display device according to the present invention.

FIG. 3 is a timing diagram of an exemplary embodiment of a signal for driving an organic light emitting display device according to the present invention and FIGS. 4A-4D illustrate operations of the exemplary organic light emitting display device during various periods shown in FIG. 3.

As shown in FIG. 3, the exemplary embodiment of an organic light emitting display device operates at a pre-charging period T1, a charging period T2, a sustaining period T3 and a light-emitting period T4, respectively.

Figure 4A:
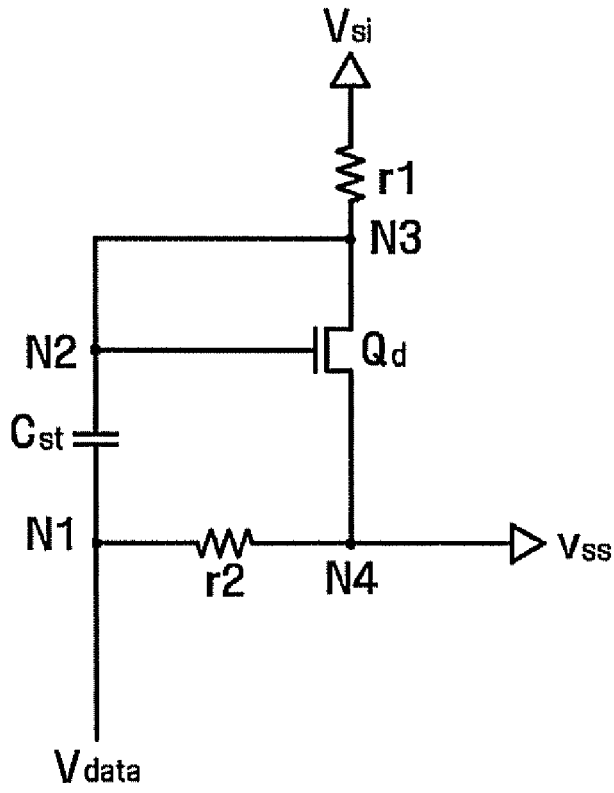
FIGS. 4A-4D illustrate operations of an exemplary embodiment of the organic light emitting display device during the time periods illustrated in FIG. 3.

Referring to FIGS. 3 and 4A, during the pre-charging period T1, a scan signal Vgi and a light-emitting signal Vsi are both at a high level. Thus, the plurality of switching TFTs Qs1 through Qs5 in the first and second switching units SI and SII (see FIG. 2) are turned on. The plurality of switching TFTs Qs1 through Qs3 in the first switching unit SI, which are fully turned on, are electrically shorted, while the plurality of switching TFTs Qs4 and Qs5 operate as first and second resistors r1 and r2 each having predetermined resistance in a linear region, as shown in FIG. 4A.

The operation of the organic light emitting display device during the pre-charging period T1 will now be described in more detail. The light-emitting signal Vsi provided through the first resistor r1 causes the driving TFT Qd to turn on because the driving TFT Qd is diode-connected. Thus, the current flowing down through the driving TFT Qd escapes to the ground voltage Vss. The image display quality of the organic light emitting display device is improved because it does not perform any unnecessary light-emitting operations during the pre-charging period T1.

The data signal Vdata escapes to the ground voltage Vss through the second resistor r2.

Here, the capacitor Cst connected between the first and second nodes N1 and N2 pre-charges a voltage difference between the first and second nodes N1 and N2. A voltage level at the first node N1 is equal to the voltage level of the data signal Vdata. A voltage level at the second node N2 is equal to the voltage level of the light-emitting signal Vsi dropped across the first resistor r1.

Figure 4B:
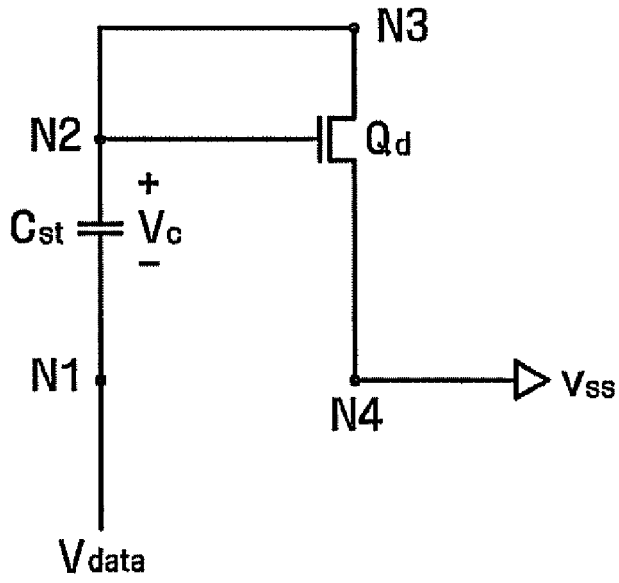

During the charging period T2, the scan signal Vgi is at a high level and the light-emitting signal Vsi is at a low level. Thus, the plurality of switching TFTs Qs1 through Qs3 (see FIG. 2) in the first switching unit SI are turned on while the plurality of switching TFTs Qs4 and Qs5 (see FIG. 2) in the second switching unit SII are turned off. The plurality of switching TFTs Qs1 through Qs3 in the first switching unit SI, which are fully turned on, are electrically shorted while the plurality of switching TFTs Qs4 and Qs5, which are fully turned off, are electrically open, as shown in FIG. 4B.

The operation of the organic light emitting display device during the charging period T2 will now be described in more detail. The voltage charged in the capacitor Cst during the pre-charging period T1 turns the driving TFT Qd on because the driving TFT Qd is diode-connected. Thus, current flows down to the ground Vss through the driving TFT Qd, thus decreasing the gate voltage of the driving TFT Qd. The gate voltage continues to drop until a gate-source voltage Vgs (between the first and fourth nodes N2 and N4 in FIG. 2) of the driving TFT Qd becomes equal to threshold voltage Vth of the driving TFT Qd so that no current flows across the driving TFT Qd.

The gate-source voltage Vgs of the driving TFT Qd during the charging period T2 is expressed by, Equation (1):

$$Vgs=Vth \tag{1}$$

Meanwhile, the data voltage Vdata continues to be applied to the first node N1. Thus, voltage Vc charged in the capacitor Cst, that is a difference between the data voltage Vdata and the gate-source voltage of the driving TFT Qd (between the second and fourth nodes N2 and N4 in FIG. 2), is defined by, Equation (2):

$$Vc=Vss+Vth-Vdata \tag{2}$$

As shown in the Equation (2), the capacitor Cst is charged with the voltage Vc which varies depending on the data voltage Vdata and the threshold voltage Vth of the driving TFT Qd.

The voltage Vc determines the amount of output current $I_{OLED}$ that flows through the OLED during the light-emitting period T4.

Figure 4C:
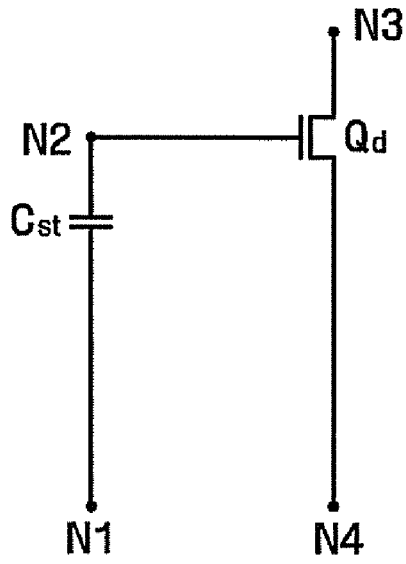

During the sustaining period T3, the scan signal Vgi, and the light-emitting signal Vsi are both at a low level. Thus, the plurality of switching TFTs Qs1 through Qs5 (see FIG. 2) in the first and second switching units SI and SII are turned off, while the plurality of switching TFTs Qs1 through Qs5 in the first and second switching units SI and SII, which are fully turned off, are electrically open, as shown in FIG. 4C.

The operation of the organic light emitting display device during the sustaining period T3 will now be described in more detail.

During the sustaining period T3, the driving TFT Qd is not diode-connected and the data voltage Vdata is not applied to the capacitor Cst and the OLED is connected to the driving TFT Qd. However, because no current flows through the driving TFT Qd, the source of the driving TFT Qd (the fourth node N4 in FIG. 2) is substantially open. Thus, the capacitor Cst maintains the voltage charged during the charging period T2.

However, if the light-emitting period T4 were to start immediately after termination of the charging period T2, the switching TFT Qs4 can be turned on before the switching TFT Qs1 may be turned off. In this case, charges may be introduced by the light-emitting signal Vsi, thus causing a change in a voltage charged in the capacitor Cst. The sustaining period T3 should be provided between the charging period T2 and the light-emitting period T4 so that the switching TFT Qs4 turns on after the switching TFT Qs1 is completely turned off thereby, the change in voltage charged in the capacitor Cst is reduced, or effectively prevented.

Figure 4D:
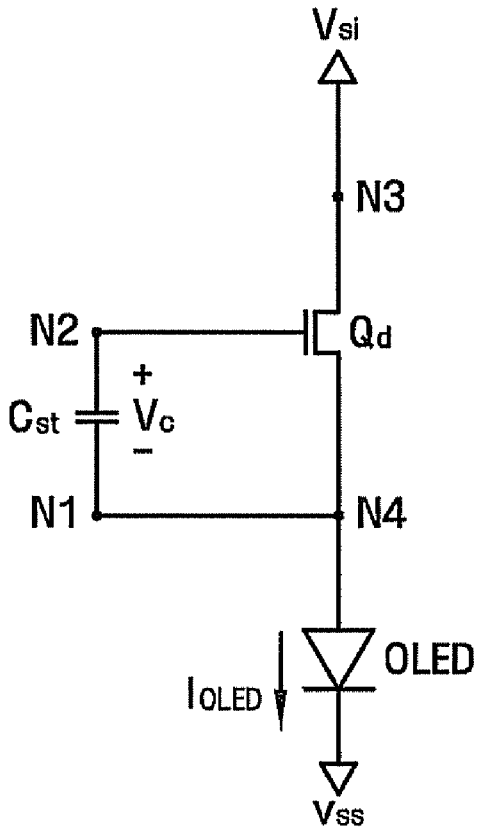

During the light-emitting period T4, the scan signal Vgi is at a low level and the light-emitting signal Vsi is at a high level. Thus, the plurality of switching TFTs Qs1 through Qs3 (see FIG. 2) in the first switching unit SI are turned off, while the plurality of switching TFTs Qs4 and Qs5 (see FIG. 2) in the second switching unit SII are turned on. The plurality of switching TFTs Qs1 through Qs3 in the first switching unit SI, which are fully turned off, are electrically open, while the plurality of switching TFTs Qs4 and Qs5, which are fully turned on, are electrically shorted, as shown in FIG. 4D.

The operation of the organic light emitting display device during the light-emitting period T4 will now be described in more detail. During the light-emitting period T4, the data voltage Vdata is not applied to the capacitor Cst and the first node N1 of the capacitor Cst and the source of the driving TFT Qd (the fourth node N4 in FIG. 2) are shorted so that the driving TFT Qd turns on. Thus, a gate-source voltage of the driving TFT Qd is equal to the voltage Vc charged in the capacitor Cst (Vgs=Vc) and the driving TFT Qd supplies the output current $I_{OLED}$ controlled by the voltage Vgs to the OLED.

Since the capacitor Cst continuously maintains the voltage Vc (=Vss+Vth−Vdata) charged during the charging period T2 regardless of a load applied by the OLED, the output current $I_{OLED}$ is defined by, Equation (3):

$$\begin{aligned} I_{OLED} &= 1/2k(Vgs - Vth)^2 \\ &\ldots = 1/2k(Vss + Vth - Vdata - Vth)^2 \\ &\ldots = 1/2k(Vss - Vdata)^2, \end{aligned} \tag{3}$$

where k is a constant determined according to the characteristics of a TFT defined by:

$$k=\mu \cdot C_{SIN\,X} W/L,$$

where μ denotes a field effect mobility, $C_{SIN\,X}$ denotes the capacity of an insulating layer, and, W and L represent the channel width and length of the TFT.

Because the output current $I_{OLED}$ at the light-emitting period T4 is determined by only the data voltage Vdata and the ground voltage Vss as shown in the Equation (3), it is not affected by changes in the threshold voltage of the driving TFT Qd as well as in the threshold voltage of the OLED. That is, the voltage charged in the capacitor Cst is kept constant regardless of changes in threshold voltage of the OLED and the voltage of the source (the voltage of the second node N2 in FIG. 2) of the driving TFT Qd.

The light-emitting period T4 continues until a pre-charging period T1 restarts for pixels of an $i^{th}$ row in a next frame. For pixels of the next row (($i^{+1th}$ row), the above operations at the periods T1 through T4 are repeated. Here, pre-charging period T1 for pixels of the $i^{+1th}$ row begins after termination of the charging period T2 for the pixels of the $i^{th}$ row. In this way, operations during the periods T1 through T4 are sequentially controlled for all scan signal lines G1 through Gn and the light-emitting signals S1 through Sn in order to display all pixels.

The duration of each of the periods T1 through T4 may be adjusted if necessary.

In one exemplary embodiment, the ground voltage Vss may be set to 0 V. A voltage for the light-emitting signal Vsi may be set high enough, e.g., 15 V, that charges may be supplied to the capacitor Cst, and the output current $I_{OLED}$ may then flow through the driving TFT Qd. When this happens, the data voltage Vdata has a negative value and the output current $I_{OLED}$ increases as the absolute value of the data voltage Vdata increases.

Figure 5:
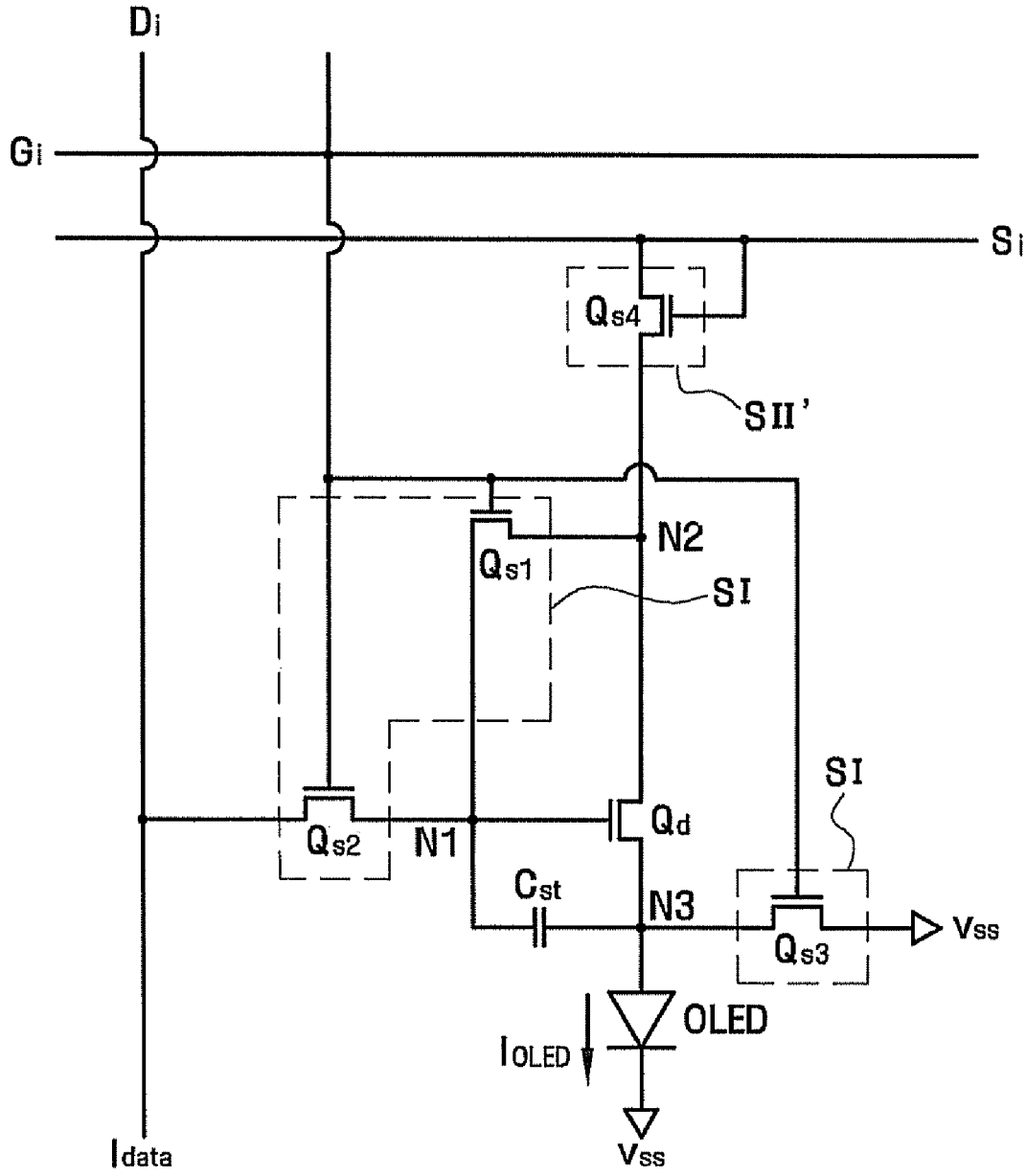
FIG. 5 is an equivalent circuit diagram of another exemplary embodiment of a pixel in an organic light emitting display device according to the present invention.

FIG. 5 is an equivalent circuit diagram of another exemplary embodiment of a pixel in an organic light emitting display device according to the present invention. For descriptive convenience, components each having the same function for describing the embodiments shown in FIG. 2 are respectively identified by the same reference numerals, and their repetitive description will be omitted.

Referring to FIG. 5, the pixel includes the first and second switching elements SI and SII' and the second switching unit SII' includes only one switching TFT Qs4.

A driving TFT Qd is formed between second and third nodes N2 and N3 and is gate-connected to a first node N1. The second node N2 is connected to the light-emitting signal lines Si via the switching TFT Qs4.

The capacitor Cst is formed between the first and third nodes N1 and N3.

The switching TFT Qs1 is connected between the first and second nodes N1 and N2 with its gate terminal connected to the scan signal line Gi. The switching TFT Qs2 is connected between data line Di, which supplies the data current Idata, and the gate of the driving TFT Qd with its gate terminal connected to the scan signal line Gi. The switching TFT Qs3 is connected between the third node N3 and the ground voltage Vss, with its gate terminal connected to the scan signal line Gi. Switching TFT Qs4 is connected between the light-emitting signal line Si and the second node N2 with its gate terminal also connected to the light-emitting signal line Si.

Figure 6:
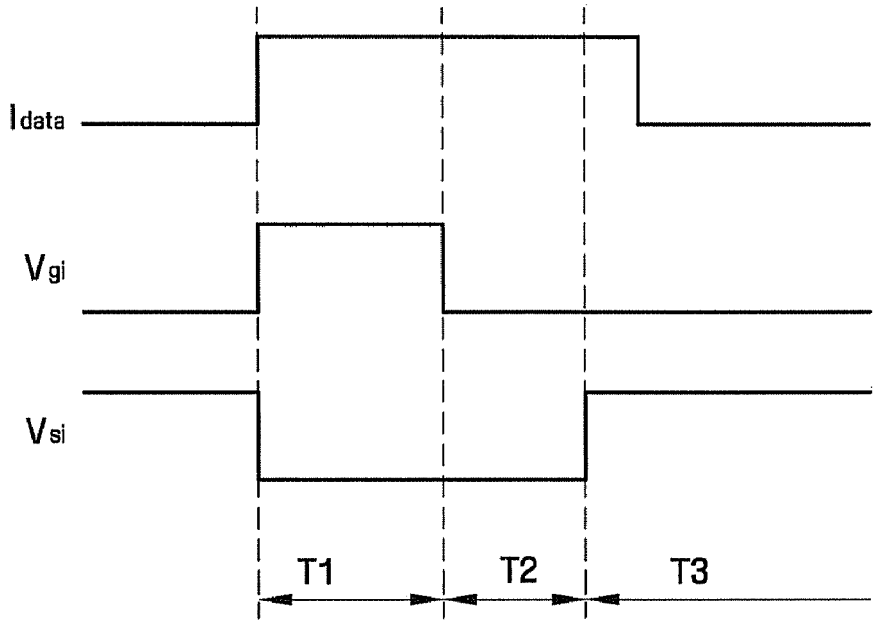
FIG. 6 is a timing diagram of an exemplary embodiment of a signal for driving an organic light emitting display device according to the present invention.
Figure 7A:
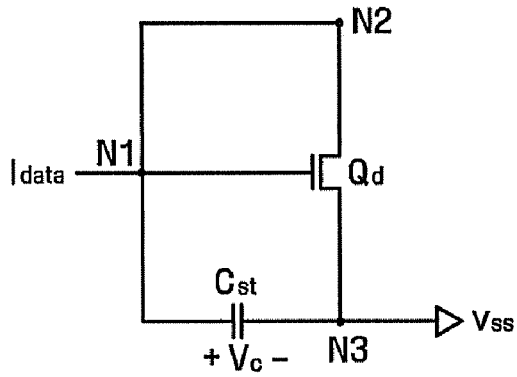
FIGS. 7A-7C are circuit schematics illustrating operation of an exemplary embodiment of the organic light emitting display device during the time periods illustrated in FIG. 6.
Figure 7B:
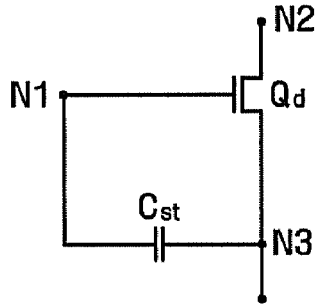
Figure 7C:
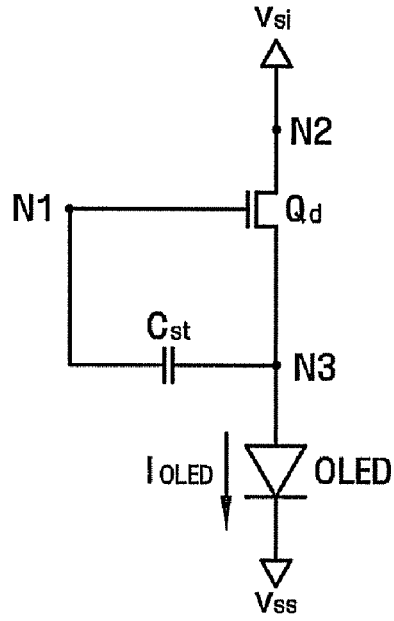

FIG. 6 is a timing diagram of an exemplary embodiment of a signal for driving an organic light emitting display device according to the present invention and FIGS. 7A-7C illustrate operations of an exemplary embodiment of the organic light emitting display device during the time periods illustrated in FIG. 6. For descriptive convenience, components each having the same function for describing the embodiments shown in FIGS. 3 through 4D are respectively identified by the same reference numerals, and their repetitive description will be omitted.

Referring to FIG. 6, the exemplary organic light emitting display device operates at a charging period T1, a holding period T2, and a light-emitting period T3 without a pre-charging period, which is because a data current Idata is directly applied to the driving TFT Qd through a data line.

Referring to FIGS. 6 and 7A, during the charging period T1, a scan signal Vgi, is at a high level and a light-emitting signal Vsi is at a low level.

The operation of the organic light emitting display device during the charging period T2 will now be described in more detail. A voltage Vgs charged in a capacitor Cst corresponds to a gate-source voltage difference between a first node N1 and a third node N3 in FIG. 5. The data current Idata during the charging period T1 is expressed by, Equation (4):

$$Idata = \tfrac{1}{2}k\,(Vgs - Vth)^2 \tag{4}$$

Solving the Equation (4) with respect to Vgs gives the following,

Equation (5):

$$Vgs=Vth+\sqrt{2Idata/k} \quad (5)$$

That is, the capacitor Cst is charged to the voltage Vgs defined by Equation (5).

Referring to FIGS. 6 and 7B, the scan signal Vgi, and the light-emitting signal Vsi are both at a low level during the holding period T2. Referring to FIG. 7B, the organic light emitting display device operates during the holding period T2 in the same way as for the sustaining period T3 (see FIGS. 3 and 4C).

Referring to FIGS. 6 and 7C, the light-emitting signal Vsi are at high levels, but the scan signal Vgi is at a low level.

Referring to FIG. 7C, like in the exemplary embodiment illustrated in FIG. 4D, the capacitor Cst is connected between the gate and source of the driving TFT Qd and the driving TFT Qd is connected to the light-emitting signal Vsi and the OLED.

The output current $I_{OLED}$ is not affected by a change in the threshold voltage of the driving TFT Qd because the change in the threshold voltage is automatically compensated for. This will now be briefly described. It is assumed that, at an initial stage without any degradation of a threshold voltage, a threshold voltage of the driving TFT Qd and a voltage charged in the capacitor Cst would be Vth1 and Vgs1, respectively. It is also assumed that, after degradation occurred, a threshold voltage and a charged voltage be Vth2 and Vgs2, respectively. Then, Vgs1 and Vgs2 are adjusted such that $$Idata=\tfrac{1}{2}k(Vgs1-Vth1)^2=\tfrac{1}{2}(Vgs2-Vth2)^2$$

to automatically compensate for the change in the threshold voltage from Vth1 to Vth2.

An exemplary embodiment of the present invention will now be described more fully through simulation results. Since details which are not described herein may be technically contemplated by those skilled in the art, the description thereabout is omitted.

Simulation Examples:

Simulations were conducted under the following conditions:

the width and length of the driving TFT Qd and switching TFTs Qs1-Qs5 was measured to be 200 μm and 4 μm, respectively; capacitance of capacitor Cst: was measured to be 0.3 pF; driving voltage and ground voltage were measured to be 15 V and 0 V, respectively; and the swing range of the scan signal Vgi and light-emitting signal Vsi was measured to be −7 to 20 V.

Figure 8:
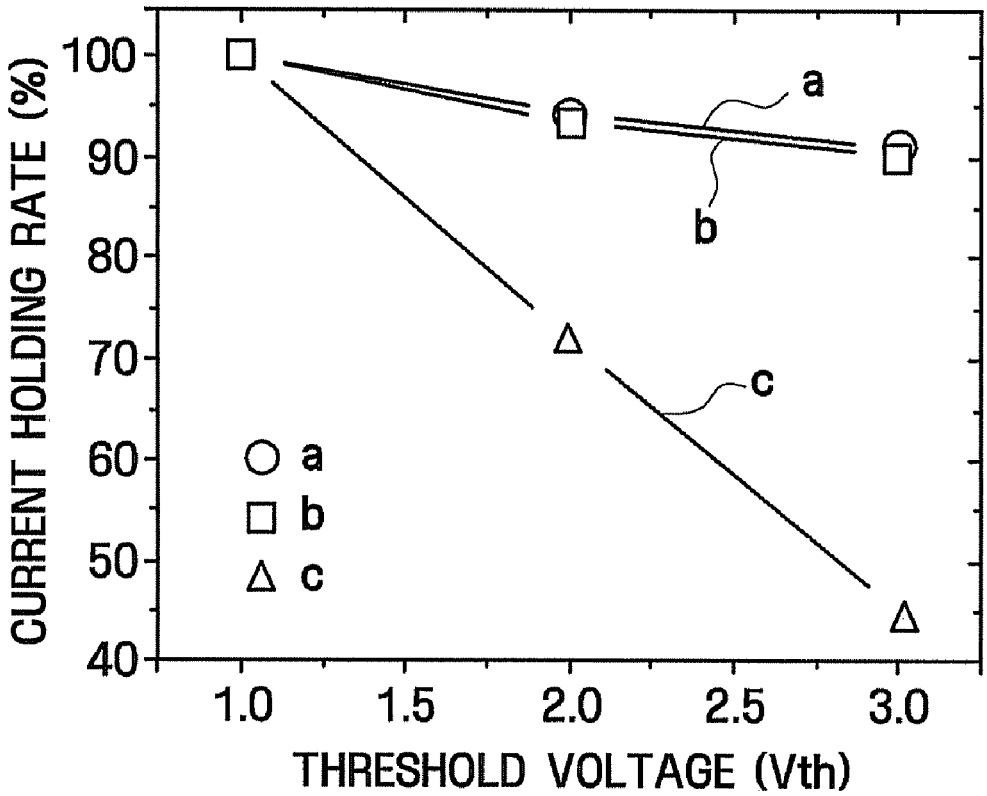
FIGS. 8 and 9 illustrate deviations in the output current flowing through an organic light emitting diode ("OLED") due to degradation of threshold voltages of a driving thin-film transistor ("TFT") and a switching TFT in an organic light emitting display device.
Figure 9:
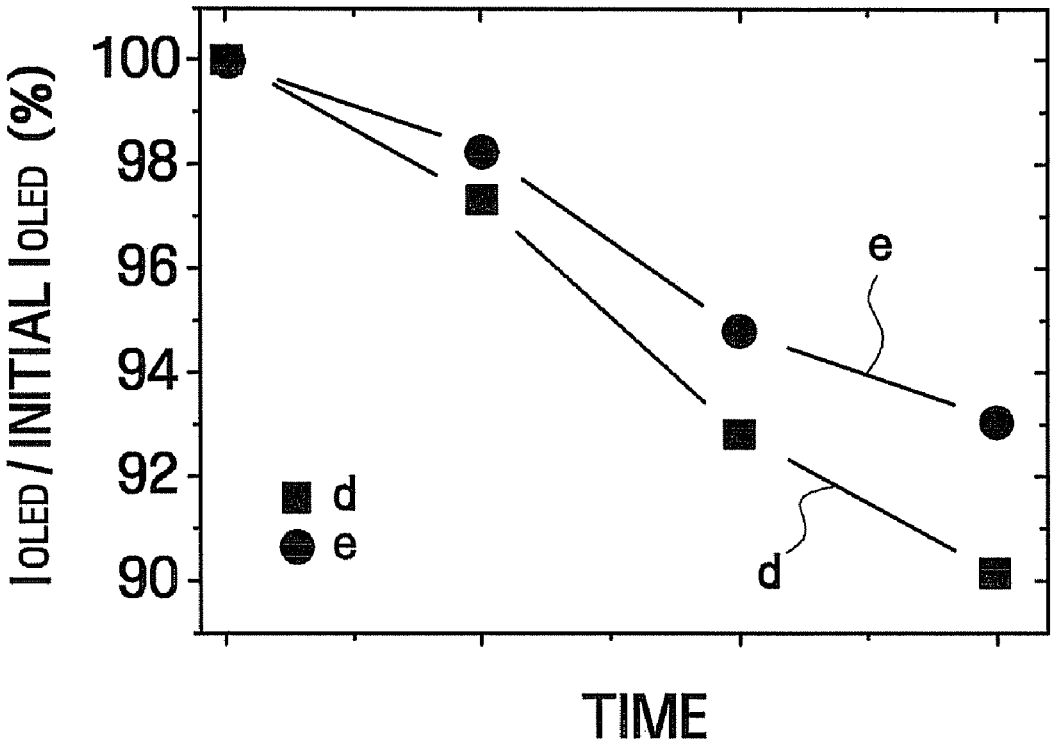

FIGS. 8 and 9 illustrate deviations in the output current flowing through an organic light emitting diode ("OLED") due to degradation of threshold voltages of a driving thin-film transistor TFT and a switching TFT in an organic light emitting display device.

In FIG. 8, the plot a (○) illustrates a current holding rate (%) of the output current $I_{OLED}$ with respect to a threshold voltage Vth of a driving TFT Qd for an exemplary embodiment of a 6-TFT pixel circuit according to the present invention using light-emitting signal lines S1 through Sn (see FIG. 2) in place of driving voltage lines, the plot b (□) illustrates a current holding rate (%) with respect to the threshold voltage Vth of the driving TFT for a 6-TFT pixel circuit according to the prior art using both light-emitting signal lines S1 through Sn and driving voltage lines (not shown), and the plot c (Δ) illustrates a current holding rate (%) with respect to the threshold voltage Vth of driving TFT Qd for a conventional 2-TFT pixel circuit (not shown), respectively.

As evident from FIG. 8, the 6-TFT pixel circuits, as represented by the plots a (○) and b (□), exhibit similar degradation compensation of output current $I_{OLED}$. In addition, as clearly confirmed by the plot a (○), the 6-TFT pixel circuit according to an exemplary embodiment of the present invention shows an excellent degradation compensation efficiency compared to the conventional 2-TFT pixel circuit, as represented by the plot c (Δ).

Referring to FIG. 9, a simulation was conducted based on the assumption that the amount of degradation of an exemplary embodiment of the switching TFT Qs4 for a 6-TFT pixel circuit according to the present invention (see FIG. 2) is seven-tenths of the degradation amount of the switching TFT for a conventional 6-TFT pixel circuit (not shown). That is, it is assumed in the simulation that threshold voltage Vth of the switching TFT Qs4 in the 6-TFT pixel circuit of the present invention is shifted by 0.7 V when the threshold voltage Vth of the switching TFT in the conventional 6-TFT pixel circuit is shifted by 1 V. In FIG. 9, the plot d (■) illustrates a current holding rate (%) over time, i.e., $I_{OLED}$/initial $I_{OLED}$, for the conventional 6-TFT pixel circuit using both light-emitting signal lines S1 through Sn and driving voltage lines and the plot e (●) illustrates a current holding rate (%) over time, i.e., $I_{OLED}$/initial $I_{OLED}$, for an exemplary embodiment of the 6-TFT pixel circuit according to the present invention using light-emitting signal lines S1 through Sn as driving voltage lines.

Parameters for several points of time of the simulation performed to determine threshold voltage degradations of the switching TFT Qs4 are shown in Table 1.

TABLE 1

| Simulation Parameters | |
|---|---|
| d | e |
| Vth | Vth |
| Vth + 1 | Vth + 0.7 |
| Vth + 2 | Vth + 1.4 |
| Vth + 3 | Vth + 2.1 |

Comparing an amount of output current of the OLED at an initial point of time to an amount of output current of the OLED at an arbitrary point of time, which can be defined as a current holding rate over time, i.e., $I_{OLED}$/initial $I_{OLED}$, if any degradation occurs to the switching TFT Qs4 (see FIG. 2), the plot e (●) exhibits a smaller drop than the plot d (■), suggesting that a current deviation is smaller in the plot e (●) than in the plot d (■).

As described above, the display device and driving method according to the present invention provide at least the following advantages.

First, since the number of signal lines is reduced using light emitting signal lines in place of driving voltage lines, an increase in the number of pixels per inch ("PPI") may be achieved. A display with more pixels per inch will result in a high pixel density, high-resolution display.

Second, use of the light emitting signal lines as the driving voltage lines can lower a degradation of a switching TFT Qs4, thereby enabling the switching TFT Qs4 to operate in a saturation region rather than in a linear region.

While the present invention has been particularly shown and described with reference to exemplary embodiments thereof, it will be understood by those of ordinary skill in the art that various changes in form and details may be made therein without departing from the spirit and scope of the present invention as defined by the following claims. Therefore, it is to be understood that the above-described exemplary embodiments have been provided only in a descriptive sense and will not be construed as placing any limitation on the scope of the invention.

What is claimed is:

1. A display device comprising:

a light-emitting element which emits light when a driving current is applied thereto;

a driving thin-film transistor controlling the magnitude of the driving current applied to the light-emitting element;

a capacitor charging a voltage which varies depending on a data voltage and a threshold voltage of the driving thin-film transistor and maintaining a voltage corresponding to a difference between the data voltage and a gate voltage of the driving thin-film transistor;

a first switching unit supplying the data voltage to the capacitor in response to a scan signal; and a second switching unit that is diode-connected and applies a light emitting signal to the driving thin-film transistor, wherein the light emitting signal is not a constant voltage signal.

2. The display device of claim 1, wherein the first switching unit comprises:

a first switching thin-film transistor diode-connecting the driving thin-film transistor; and a second switching thin-film transistor charging the data voltage in the capacitor in response to the scan signal.

3. The display device of claim 2, wherein the first switching unit further comprises a third switching thin-film transistor removing a residual current applied to the light-emitting element in response to the scan signal.

4. The display device of claim 3, wherein the second switching unit comprises:

a fourth switching thin-film transistor which is diode-connected and connects a light emitting signal line with the driving thin-film transistor; and a fifth switching thin-film transistor connecting the capacitor, the driving thin-film transistor, and the light-emitting element in response to the light emitting signal.

5. The display device of claim 4, wherein the voltage maintained in the capacitor is a voltage corresponding to a sum of a ground voltage and the threshold voltage minus the data voltage.

6. The display device of claim 4, wherein the data voltage has a negative value.

7. The display device of claim 4, wherein the first through fifth switching thin-film transistors and the driving thin-film transistor are formed of amorphous silicon.

8. The display device of claim 4, wherein the light-emitting element includes an organic light-emitting layer.

9. The display device of claim 4, wherein the first through fifth switching thin-film transistors and the driving thin-film transistor are n-channel metal oxide semiconductor thin-film transistors.

10. The display device of claim 4, wherein the first and second switching units are turned on during a first period among sequentially continuing first through fourth periods, the first switching unit is turned on and the second switching unit is turned off during the second period, the first and second switching units are turned off during the third period, and the first switching unit is turned off and the second switching unit is turned on during the fourth period.

11. A display device comprising:

a capacitor formed between a first and a second node;

a light-emitting element which emits light when a driving current is applied thereto;

a driving thin-film transistor formed between the light-emitting element and a third node which controls the magnitude of the driving current applied to the light-emitting element;

a first switching unit including first through third switching thin-film transistors gated in response to a scan signal, wherein the first switching thin-film transistor is formed between the second and third node, the second switching thin-film transistor is formed between the first node and a data line, and the third switching thin-film transistor is formed between the light-emitting element and a ground voltage line; and a second switching unit including fourth and fifth switching thin-film transistors gated in response to a light emitting signal, wherein the fourth switching thin-film transistor is diode-connected to a light-emitting signal line and the fifth switching thin-film transistor is formed between the first node and the light-emitting element, wherein the light emitting signal is not a constant voltage signal.

12. A display device comprising:

a light-emitting element which emits light when a driving current is applied thereto;

a driving thin-film transistor controlling the magnitude of the driving current applied to the light-emitting element;

a capacitor charging a voltage which varies depending on a data current and a threshold voltage of the driving thin-film transistor and maintaining a voltage corresponding to a difference between a gate-source voltage and the threshold voltage of the driving thin-film transistor;

a first switching unit supplying the data current to the capacitor in response to a scan signal; and a second switching unit which is diode-connected and applies a light-emitting signal to the driving thin-film transistor, wherein the light emitting signal is not a constant voltage signal.

13. The display device of claim 12, wherein the first switching unit comprises:

a first switching thin-film transistor diode-connecting the driving thin-film transistor in response to the scan signal; and a second switching thin-film transistor charging the voltage which varies depending on a data current and a threshold voltage of the driving thin-film transistor in the capacitor in response to the scan signal.

14. The display device of claim 13, wherein the first switching unit further comprises a third switching thin-film transistor removing a residual current being applied to the light-emitting element in response to the scan signal.

15. The display device of claim 14, wherein the second switching unit comprises a fourth switching thin-film transistor which is diode-connected and connects a light emitting signal line with the driving thin-film transistor.

16. The display device of claim 15, wherein the first through fourth switching thin-film transistors and the driving thin-film transistor are formed of amorphous silicon.

17. The display device of claim 15, wherein the light-emitting element includes an organic emitting layer.

18. The display device of claim 15, wherein the first through fourth switching thin-film transistors and the driving thin-film transistor are formed of n-channel metal oxide semiconductor thin-film transistors.

19. The display device of claim 15, wherein among first through third periods arranged in sequence, during the first period, the first switching unit is turned on and the second switching unit is turned off; during the second period, the first and second switching units are turned off; and during the third period, the first switching unit is turned off and the second switching unit is turned on.

20. A display device comprising:

a capacitor formed between a first node and a third node;

a light-emitting element which emits light when a driving current is applied thereto;

a driving thin-film transistor formed between the light-emitting element and a second node which controls the magnitude of the driving current applied to the light-emitting element;

a first switching unit including first through third switching thin-film transistors gated in response to a scan signal, wherein the first switching thin-film transistor is formed between the first and second node, the second switching thin-film transistor is formed between the first node and a data line, and the third switching thin-film transistor is formed between the light-emitting element and a ground voltage line; and a second switching unit including a fourth switching thin-film transistor gated in response to a light emitting signal, wherein the fourth switching thin-film transistor is formed between the second node and a light emitting signal line, wherein the light emitting signal is not a constant voltage signal.

21. A method for driving a display device including a light-emitting element which emits light when a driving current is applied thereto; a driving thin-film transistor controlling the magnitude of the driving current applied to the light-emitting element; a capacitor charging a voltage which varies depending on a data voltage and a threshold voltage of the driving thin-film transistor and maintaining a voltage corresponding to a difference between the data voltage and a gate voltage of the driving thin-film transistor; a first switching unit supplying the data voltage to the capacitor in response to a scan signal; and a second switching unit which is diode-connected and applies a light emitting signal to the driving thin-film transistor, the method comprising:

pre-charging the capacitor to a predetermined voltage;

charging the capacitor to a voltage corresponding to the difference between the data voltage and the gate voltage of the driving thin-film transistor;

maintaining the voltage corresponding to the difference between the data voltage and the gate voltage of the driving thin-film transistor; and emitting light from the light-emitting element using the voltage corresponding to the difference between the data voltage and the gate voltage of the driving thin-film transistor, wherein the light emitting signal is not a constant voltage signal.

22. The method of claim 21, wherein the pre-charging of the capacitor comprises fully turning on the first switching unit and operating the second switching unit in a linear region.

23. The method of claim 21, wherein the charging of the capacitor comprises fully turning on the first switching unit and filly turning off the second switching unit.

24. The method of claim 21, wherein the maintaining of the voltage comprises fully turning off the first and second switching units.

25. The method of claim 21, wherein the emitting of the light comprises fully turning off the first switching unit and fully turning on the second switching unit.

26. A method for driving a display device including a light-emitting element which emits light when a driving current is applied thereto; a driving thin-film transistor controlling the magnitude of the driving current applied to the light-emitting element; a capacitor charging a voltage which varies depending on a data current and a threshold voltage of the driving thin-film transistor and maintaining a voltage corresponding to a difference between a gate-source voltage and the threshold voltage of the driving thin-film transistor; a first switching unit supplying the data current to the capacitor in response to a scan signal; and a second switching unit which is diode-connected and applies a light-emitting signal to the driving thin-film transistor; the method comprising:

charging the capacitor to a predetermined voltage depending on the data current and the threshold voltage of the driving thin-film transistor;

maintaining the voltage charged in the capacitor corresponding to a difference between the gate-source voltage and the threshold voltage of the driving thin-film transistor; and emitting light from the light-emitting element using the voltage corresponding to a difference between the gate-source voltage and the threshold voltage of the driving thin-film transistor, wherein the light emitting signal is not a constant voltage signal.

* * * * *